United States Patent [19]

Asselin

[11] 4,046,675

[45] Sept. 6, 1977

[54] AROMATIC HYDROCARBON SEPARATION VIA SOLVENT EXTRACTION

[75] Inventor: George F. Asselin, Mount Prospect, Ill.

[73] Assignee: UOP Inc., Des Plaines, Ill.

[21] Appl. No.: 679,275

[22] Filed: Apr. 22, 1976

[51] Int. Cl.[2] ..... C10G 21/28

[52] U.S. Cl. ..... 208/321; 260/674 SE

[58] Field of Search ..... 208/321; 260/674 SE

[56] References Cited

U.S. PATENT DOCUMENTS

| | | | |
|---|---|---|---|
| 3,065,169 | 11/1962 | Luiderweg et al. | 208/321 |
| 3,396,101 | 8/1968 | Broughton | 208/313 |
| 3,466,346 | 9/1969 | DeGraff et al. | 260/674 SE |

*Primary Examiner*—Herbert Levine

*Attorney, Agent, or Firm*—James R. Hoatson, Jr.; Robert W. Erickson; William H. Page, II

[57] ABSTRACT

A solvent extraction process for separating polar hydrocarbons from non-polar hydrocarbons. The solvent-rich extract phase is introduced into a stripping column, the bottoms from which, a polar hydrocarbon-containing, solvent-rich stream, is introduced into an upper portion of a solvent recovery column. A vaporous stripping medium is introduced into a lower portion of the solvent recovery column. Polar hydrocarbons in concentrated form are recovered as an overhead stream, a solvent-rich stream, virtually free from hydrocarbons, is withdrawn as a bottoms product and recycled to the extraction zone, while a hydrocarbon-containing side-cut solvent-rich phase is withdrawn and introduced into the stripping column with the extract phase.

10 Claims, 1 Drawing Figure

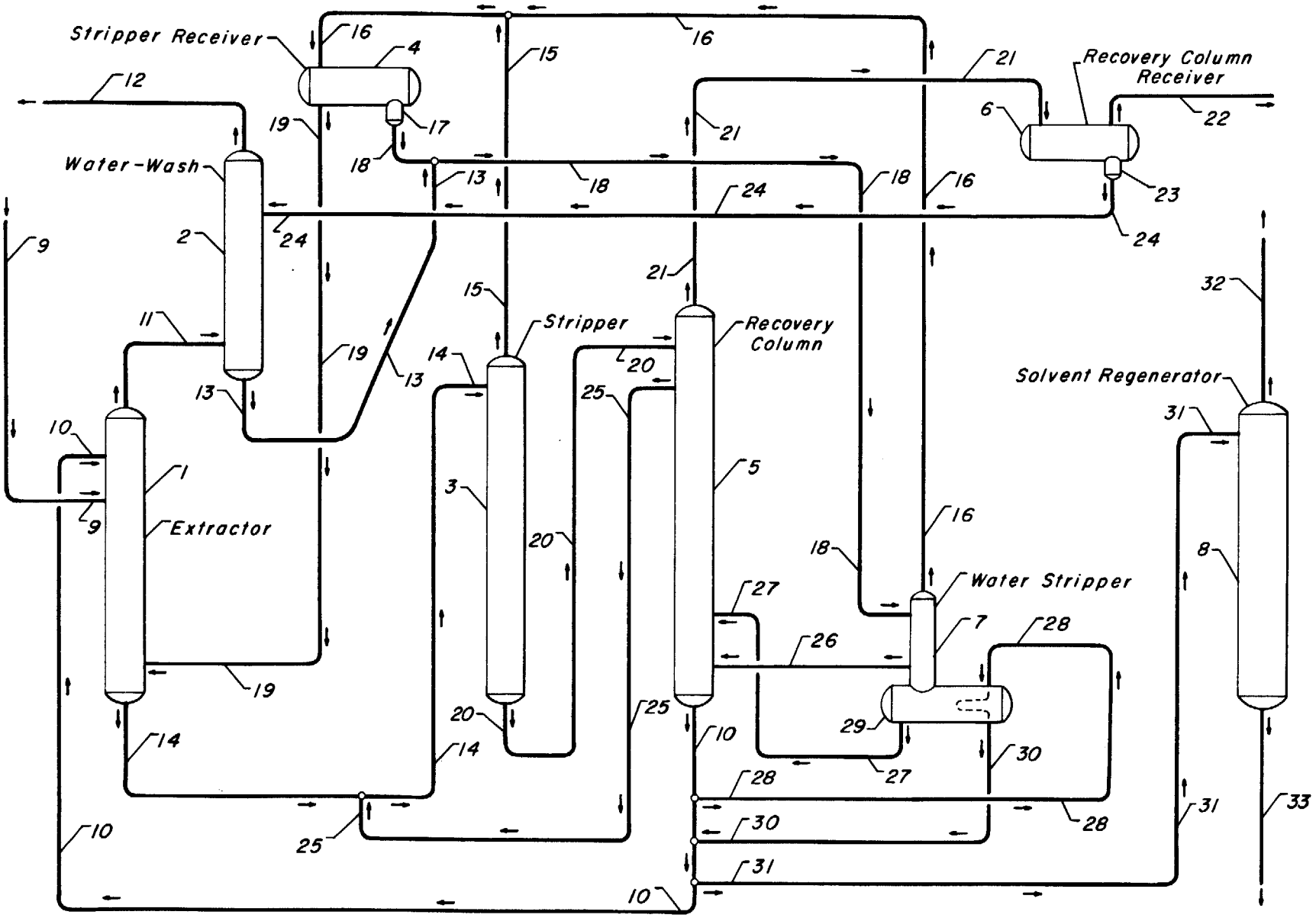
Recovery Column Receiver
Solvent Regenerator
Water Stripper
Recovery Column
Stripper
Stripper Receiver
Water-Wash
Extractor

AROMATIC HYDROCARBON SEPARATION VIA SOLVENT EXTRACTION

APPLICABILITY OF INVENTION

As herein described, the present invention is adaptable for use in the separation and ultimate recovery of polar hydrocarbons from non-polar hydrocarbons, which separation is effected through the use of a solvent characteristically selective for absorbing polar hydrocarbons. More specifically, my invention is directed toward the separation and recovery of aromatic hydrocarbons from various mixtures thereof with non-aromatic hydrocarbons. The use of the terms "polar" and "non-polar" in the present specification and appended claims, is intended to distinquish between classes of hydrocarbons wherein one particular type is more polar than the other. For example, in an extraction process intended to recover naphthenes from a mixture thereof with paraffins, the former are polar and the latter non-polar. When extracting aromatics from a mixture thereof with naphthenes, the naphthenes are considered non-polar with respect to the aromatic hydrocarbons which are polar.

In one of its specific applications, the separation process evolved from the present invention serves to segregate particular species of aromatic hydrocarbons such as benzene, toluene and/or $C_8$-aromatics from other hydrocarbons normally contained in petroleum fractions and distillates. The process utilizes a solvent which may be indefinitely recycled within the system, yields the desired product in high purity and separates the same substantially in its entirety from the feedstocks charged to the process. My invention is particularly applicable as an improvement in the type of separation process wherein a mixture of various classes of hydrocarbons is introduced into an extraction zone, generally at an intermediate locus in the height thereof, and is countercurrently contacted therein with a solvent selective for aromatic hydrocarbon adsorption. A raffinate phase, comprising substantially all of the non-aromatic hydrocarbons in the feedstock, is removed from one end portion of the extraction zone at which the solvent is introduced. An extract phase comprising the aromatic components of the feedstock, the selected solvent and some non-aromatic components is removed from the other end portion of the extraction zone, and the aromatic solute is substantially recovered by stripping and fractionating the extract phase.

Although my invention is applicable for utilization with any hydrocarbon feedstock having a sufficiently high aromatic concentration to justify the recovery thereof — e.g. from about 15.0 to about 50.0% by volume — distinct advantages are afforded when processing those feedstocks having an aromatic concentration exceeding about 75.0% by volume. Exemplary of various sources of suitable charge stocks are the depentanized effluent from a catalytic reforming unit, wash oils, and especially coke oven by-products and hydrotreated pyrolysis naphthas.

Briefly, the present inventive concept involves introducing a mixture of polar hydrocarbons, non-polar hydrocarbons and the characteristically selective solvent into a first fractionation column (stripping column). The bottoms, a solvent-rich polar hydrocarbon-containing stream is introduced into a second fractionating column (solvent recovery column), from which a hydrocarbon-containing, solvent-rich stream is withdrawn as a side-cut and introduced into the first fractionation column, preferably in admixture with the feed stream thereto. A vaporous stripping medium is introduced into the bottom portion of the second fractionation column which permits recovery of substantially aromatic hydrocarbon-free solvent as the bottom stream.

PRIOR ART

It must be recognized that the prior art proliferates in a wide spectrum of solvent extraction techniques for effecting the separation of aromatic hydrocarbons from a mixture thereof with non-aromatic hydrocarbons. No attempt will be made herein to delineate exhaustively the appropriate published literature; it will suffice simply to note several examples which appear to be exemplary of various prior art practices, and to which the present invention is most applicable. The overwhelming majority of solvent extraction processes indicate a distinct preference for a water-soluble solvent comprising an oxygenated organic compound. A review of the relevant prior art indicates that the prevalent solvent is either a sulfolane-type organic compound, or an alkylene glycol, preferably a polyalkylene glycol. While most prior art processes are intended for utilization with either of the water-soluble solvents, specific techniques have been illustrated previously which are peculiar either to one, or the other.

The use of a light paraffin backwash stream in the solvent extraction column, to displace heavier non-aromatic components from the extract phase, is shown in U.S. Pat. No. 3,037,062 (Cl. 260-674), issued May 29, 1962. The aromatic concentrate is recovered as a side-cut from the stripping column and subsequently introduced into fractionation facilities for separation into the individual aromatic components. The rectification of a solvent-rich side-cut from the stripping zone is disclosed in U.S. Pat. No. 3,173,966 (Cl. 260-674), issued Mar. 16, 1965. This technique affords the recovery of substantially solvent-free water for subsequent utilization within the process.

U.S. Pat. No. 3,396,101 (Cl. 208-313), issued Aug. 6, 1968, involves introducing a mixture of charge stock and lean solvent into the stripping column from which a non-aromatic overhead stream is withdrawn and introduced into the extraction zone. The resulting rich solvent is passed from the extraction zone to the stripping column as a second feed stream thereto. The bottoms from the stripping column is introduced into a solvent recovery zone, the recovered solvent being withdrawn as a single bottoms stream for recycle in part to the extraction zone and in part to the stripping column. Noteworthy is the fact that a recovery column side-cut is not withdrawn and introduced directly into the stripping column.

In U.S. Pat. No. 3,436,435 Cl. 260-674), issued Apr. 1, 1969, an aromatic side-cut is withdrawn from the stripping column, introduced into an entrainment separator from which an aromatic concentrate is subsequently transported to fractionation facilities. A solvent-containing bottoms stream is withdrawn from the entrainment separator and reintroduced into an intermediate locus of the stripping column.

Still another variation is that found in U.S. Pat. No. 3,723,245 (Cl. 203-43), issued Mar. 27, 1973. Initially, the aromatic hydrocarbon feed is introduced into a distillation column from which a light fraction and a heavier bottoms fraction are recovered. The former is passed into an extractive distillation tower while the latter is introduced into a liquid extraction unit. The extract from the liquid extraction unit is stripped of non-aromatic hydrocarbons to produce a non-aromatics free fraction and a non-aromatics containing fraction. The aromatic stream recovered in admixture with the solvent, from the extractive distillation column, is passed to a recovery section in admixture with the aromatic-containing fraction from the stripping zone. The overhead stream from the extractive distillation column and the non-aromatics from the stripping zone are passed in admixture to the bottom section of the solvent extraction zone, to function therein as a reflux stream.

U.S. Pat. No. 3,466,346 (Cl. 260-674), issued Sept. 9, 1969, is specifically directed toward the separation of the extract phase from the solvent extraction zone. The technique involves withdrawing, from both the extractive distillation column and the aromatic recovery distillation column, a side-cut fraction. With respect to the extractive distillation column, the side-cut fraction is introduced as a vapor directly into the aromatic recovery column. The side-cut fraction from the aromatic recovery column, being a lean solvent stream containing aromatic hydrocarbon, is returned to the extractive distillation column in admixture with the extract phase introduced thereto. It should be noted that there is no awareness respecting the introduction of a vaporous stripping medium into the lower portion of the recovery column.

The utilization of the present inventive concept significantly decreases the quantity of hydrocarbons remaining in the lean solvent stream withdrawn from the bottom of the solvent recovery column. Since this lean solvent stream is recycled to the solvent extraction zone, for re-use therein, the efficiency of separation effected therein is further enhanced.

OBJECTS AND EMBODIMENTS

A principal object of my invention is to enhance and facilitate the recovery of polar hydrocarbons from a mixture thereof with non-polar hydrocarbons. A corollary objective resides in a method for separating the polar hydrocarbons from a mixture thereof with non-polar hydrocarbons and a solvent characteristically selective for absorbing the polar hydrocarbons.

A specific object of my invention is to effect a reduction in the cost of utilities (energy savings) while separating aromatic hydrocarbons from a mixture thereof with non-aromatic hydrocarbons and the selective solvent without detrimentally affecting the efficiency with which aromatic hydrocarbons are originally extracted from a mixture thereof with non-aromatic hydrocarbons.

Therefore, one embodiment of my invention is directed toward a method for separating polar hydrocarbons from a mixture thereof with non-polar hydrocarbons and a solvent characteristically selective for absorbing polar hydrocarbons, which method comprises the steps of: (a) introducing said mixture into a first fractionation column, removing a non-polar hydrocarbon-rich stream from an upper portion of said first column and removing a solvent-rich polar hydrocarbon-containing stream from a lower portion of said first column; (b) introducing at least a portion of said solvent-rich, polar hydrocarbon-containing stream into a second fractionating column, removing a polar hydrocarbon-rich stream, substantially free from solvent and non-polar hydrocarbons, from an upper portion of said second column, removing a first solvent-rich stream, substantially free from hydrocarbon, from a lower portion of said second column and removing a hydrocarbon-containing, second solvent-rich stream from an intermediate portion of said second solumn; (c) introducing a vaporous stripping medium into said second fractionation column through a locus below that from which said second solvent-rich stream is removed; and, (d) introducing at least a portion of said second solvent-rich stream into said first fractionation column.

A specific embodiment of the present invention is directed toward a process for the recovery of aromatic hydrocarbons from a mixture thereof with non-aromatic hydrocarbons, which process comprises the steps of: (a) introducing said mixture with a solvent characteristically selective for absorbing aromatic hydrocarbons, at conditions selected to maintain said mixture and solvent in liquid phase; (b) removing a non-aromatic raffinate stream from said zone, through an upper locus thereof; (c) removing an aromatic, solvent-rich extract stream from said zone, through a lower locus thereof, and introducing said extract stream into a stripper column; (d) removing a non-aromatic concentrate from said stripper column, through an upper locus thereof, and removing a solvent-rich aromatic concentrate from said stripper column, through a lower locus thereof; (e) introducing said aromatic concentrate into a recovery column, through a first locus thereof, introducing a vaporous stripping medium into a lower, second locus thereof, recovering a substantially solvent-free aromatic concentrate through an upper, third locus thereof, removing a substantially hydrocarbon-free, first solvent-rich stream from a lower, fourth locus thereof and removing a second solvent-rich stream, containing hydrocarbon, through a fifth locus intermediate said first and second loci; and, (f) introducing at least a portion of said second solvent-rich stream into said stripper column.

Other objects and embodiments of my invention will become evident from the following more detailed description thereof. In one such other embodiment, the volumetric ratio of the first solvent-rich stream, both of which are removed from the recovery column, is in the range of about 1.5:1.0 to about 4.0:1.0.

SUMMARY OF INVENTION

As hereinbefore set forth, the technique encompassed by my invention concept is intended for integration into a solvent extraction process for the selective separation and recovery of polar hydrocarbons from a mixture thereof with non-polar hydrocarbons. Although thus applicable to a multitude of hydrocarbon mixtures, the following dicussion will be directed primarily to the separation and recovery of aromatic hydrocarbons from a mixture thereof with paraffins and/or naphthenes. Initially, the mixture of hydrocarbons in contacted with a water-soluble, oxygen-containing solvent characteristically selective for the extraction of polar hydrocarbons. There is recovered, from the solvent extraction zone, an extract stream containing aromatic hydrocarbons and a major proportion of the water-soluble solvent, and a raffinate stream containing non-aromatic hydrocarbons and a relatively minor proportion of the water-solvent. The raffinate stream is generally contacted, in countercurrent flow, with water to recover the solvent and to provide a hydrocarbon concentrate which is substantially free from solvent.

The extract phase, removed from a lower portion of the solvent extraction column, is introduced into the upper portion of a stripping column, the principal function of which is to remove non-aromatic hydrocarbons in an overhead stream. Two types of columns currently in use are suitable for utilization herein: the first type is characterized by the introduction of a vaporous stripping medium directly into the lower portion of the stripping column for the purpose of countercurrently contacting the extract phase; in the second type, hereinafter illustrated, the stripping column is of the reboiler type wherein the required heat-input is supplied either by the external reboiling of bottoms material which is reintroduced directly, or through the utilization of a stab-in reboiler heater. The overhead stream withdrawn from the stripping column will be a hydrocarbon concentrate containing some solvent and water. This stream is introduced into a so-called overhead stripper receiver for separation into a hydrocarbon phase and a solvent/water phase. The hydrocarbon phase, substantially free from solvent and water is introduced into the lower portion of the extraction zone as reflux thereto, and to recover aromatics therein. The solvent/water phase is conveniently combined with the substantially hydrocarbon-free solvent/water phase from the raffinate water-wash column, the mixture being introduced into the upper portion of a water stripping column.

The solvent-rich, aromatic concentrate, substantially free from non-aromatic hydrocarbons, withdrawn from the lower portion of the stripping column, is generally introduced into the upper, central portion of a solvent recovery column. An aromatic concentrate, containing water and being substantially free from solvent, is withdrawn as an overhead stream from the solvent recovery column and introduced into an overhead receiver. The overhead receiver serves to effect a phase separation between the aromatic hydrocarbons, which are recovered, and the water phase which is introduced into the upper portion of the water-wash column countercurrently contacting the raffinate phase therein. A solvent-rich stream, substantially free from hydrocarbons, is withdrawn from the bottom of the solvent recovery column. The greater proportion thereof is introduced into the top of the solvent extraction zone to countercurrently contact the mixed hydrocarbon feed stream. A relatively minor portion of the solvent recovery column bottoms material is often diverted and introduced into a solvent regenerator, the regenerated solvent generally being combined with the solvent feed to the extraction zone. In accordance with the present separation method, a solvent-rich stream, containing hydrocarbons, is withdrawn from an intermediate portion of the solvent recovery column and introduced into the upper portion of the stripping column, preferably in admixture with the feed thereto. As hereinafter indicated, this technique affords advantages respecting operational costs attributed to utilities. However, to ensure that this particular technique does not cause hydrocarbons to be withdrawn with the solvent-rich recovery column bottom stream, a stripping medium is introduced into the lower portion of the solvent recovery column. Further, in accordance with the present invention, the vaporous stripping medium is withdrawn from the lower portion of the water stripping column into which the water phase from the stripper overhead receiver and from the water-wash column are introduced. The overhead stream from the water stripping column is introduced into the stripper overhead receiver in admixture with the overhead stream from the stripping column. In a preferred embodiment, the water stripping column is maintained at conditions of temperature and pressure which produces the vaporous stripping medium for introduction directly into the lower portion of the solvent recovery column, as well as a solvent-containing bottoms liquid preferably introduced into the recovery column through a locus between that from which the solvent-rich side-cut is withdrawn and the stripping medium is introduced.

The withdrawal of the hydrocarbon-containing, solvent-rich side-cut from the recovery column, reduces the load on the reboiler section thereof. The introduction of the side-cut into the upper portion of the stripping column affords better separation therein between aromatic and non-aromatic hydrocarbons. Furthermore, the quantity of heat-input to the reboiler section of the main stripping column, required to strip non-aromatics from the stripper feed, is significantly reduced. With respect to utilities, energy consumption is, therefore, significantly reduced. Since this technique can lead to the appearance of hydrocarbons, especially aromatics, in the solvent-rich bottoms from the recovery column, which stream is introduced into the extraction zone, my invention also provides for the introduction of an internally-produced stripping medium directly into the lower portion of the solvent recovery column. The solvent-rich bottoms stream recycled to the extraction column is virtually completely free from hydrocarbons.

SOLVENTS AND OPERATING CONDITIONS

Generally accepted solvents, having solubility selectivity for aromatic hydrocarbons, are water-soluble, oxygen-containing organic compounds. In order to be effective in a solvent extraction system, such as the process provided by the present invention, the solvent component must have a boiling point substantially greater than water, added to the solvent composition for enhancing its selectivity, and, in general, must also have a boiling point substantially greater than the end boiling point of the hydrocarbon feedstock. The solvent composition generally has a density greater than the hydrocarbon feedstock and is, accordingly, introduced into the uppermost portion of the solvent extraction zone, thereafter flowing downwardly, countercurrent to the rising hydrocarbon feedstock.

Organic compounds suitable as the solvent component may be selected from the relatively large group of compounds characterized generally as oxygen-containing compounds, particularly the aliphatic and cyclic alcohols, the glycols and glycol ethers, as well as glycol esters. The mono- and polyalkylene glycols in which the akylene group contains from about 2 to about 4 carbon atoms, such as ethylene glycol, diethylene glycol, triethylene glycol and tetraethylene glycol, propylene glycol, dipropylene glycol, and tripropylene glycol constitute a particularly preferred class of organic solvents useful in admixture with water.

Another particularly suitable class of selected solvents are those commonly referred to as the sulfolane-type. By this, I intend a solvent having a five-membered ring, one atom of which is sulfur, the other four being carbon and having two oxygen atoms bonded to the sulfur atom. The four carbon atoms may be linked with hydrogen or alkyl groups. Other solvents preferably included are the sulfolenes such as 2-sulfolene or 3-sulfolene.

The solvent generally contains a small amount of water dissolved therein to increase the selectivity of the solvent phase for aromatic hydrocarbons over non-aromatic hydrocarbons without substantially reducing the solubility of the solvent phase for the aromatic hydrocarbons. The presence of water in the solvent composition provides a relatively volatile material which is distilled from the fat solvent in the stripping column to vaporize the last traces of non-aromatic hydrocarbons by way of steam distillation. The solvent composition, contains from about 0.3 to about 25.0% by weight of water, depending upon the particular solvent employed and the process conditions under which the various major vessels are operated. By including water in the solvent composition, the solubility of aromatic hydrocarbons in the solvent, although somewhat reduced in comparison with a non-aqueous solvent, greatly decreases the solubility of non-aromatic raffinate components in the solvent and also reduces the solubility of solvent in the raffinate stream. Although the quantity of solvent in the raffinate at any given instance is relatively small, the cumulative effect of small amounts of solvent in a stream removed from the process flow and thus otherwise lost, greatly reduces the efficiency and economy of the solvent extraction process. The recovery of solvent from the raffinate stream can be accomplished efficiently by countercurrently washing the same with water in a separate washing zone from which an aqueous wash effluent is recovered containing the solvent.

The solvent extraction zone is maintained at conditions of temperature and pressure selected to maintain the solvent and hydrocarbons in liquid phase. Suitable temperatures are within the range of from about 80° F. (26.7° C.) to about 400° F. (204° C.), and preferably at an intermediate level in the range of about 150° F. (65° C.) to about 300° F. (149° C.). The extraction zone will generally function at a pressure from about atmospheric to about 400 psig. (28.22 atm.), and preferably from about 50 psig. (4.41 atm.) to about 150 psig. (11.21 atm.).

The stripping column is generally maintained at moderate pressures and sufficiently high temperatures to produce an overhead stream containing all the non-aromatic hydrocarbons. Typical pressures are in the range of about atmospheric to about 50 psig. (4.41 atm.) although the pressure at the top of the stripper is generally maintained at a level of about 5.0 psig. (1.34 atm.) to about 20.0 psig. (2.36 atm.). Suitable operating temperatures are within the range of about 225° F. (107° C.) to 400° F. (204° C.). Solvent recovery is effected at temperatures ranging from about 130° F. (54° C.) to about 375° F. (191° C.). The recovery column will function at a pressure less than 1.0 atmosphere, and generally at a level of about 80 mm. Hg., absolute to about 700 mm. Hg., absolute.

The water-wash column, utilized to remove solvent from the non-aromatic raffinate, will function at a relatively low pressure of about 30 psig. (3.04 atm.) to about 75 psig. (6.10 atm.). Moderate temperatures are also employed, and will range from about 70° F. (21.1° C.) to about 130° F. (54° C.). The water-stripping column is maintained at temperatures in the range of about 200° F. (93° C.) to about 300° F. (149° C.), and pressures from about atmospheric to about 20 psig. (2.36 atm.).

Other operating conditions will be given in conjunction with the description of the present invention as illustrated in the accompanying drawing. Miscellaneous appurtenances, not believed required by those possessing the requisite expertise in the appropriate art, have been eliminated from the drawing. The use of details such as pumps, compressors, controls and instrumentation, heat-recovery circuits, valving, start-up lines and similar hardware, etc., is well within the purview of those skilled in the art. It is understood that the illustration as presented is not intended to limit my invention beyond the scope and spirit of the appended claims.

DESCRIPTION OF DRAWING

With specific reference now to the drawing, which presents the illustration as a simplified diagrammatic flow scheme, it will be noted that only the major vessels are shown. These are: solvent extraction zone 1; raffinate water-wash column 2; stripping column 3 and the stripper overhead receiver 4; the solvent recovery column 5 and the recovery column overhead receiver 6; water-stripping column 7; and, solvent regenerator 8. Further description of the accompanying drawing will be made in conjunction with a commercially-scaled system designed to process approximately 5,500 Bbl/day (36.43 $M^3$/hr.) of an aromatic-rich blend of pyrolysis naphtha and coke oven light oil. The feedstock has a molecular weight of about 83.5 lb/mole, and contains about 88.1% by volume aromatics, 6.1% paraffins and 5.8% naphthenes, having six to about nine carbon atoms per molecule.

The aromatic-rich charge stock, in an amount of about 812.08 lb-moles/hr. (369.13 kg-moles/hr.) is introduced into extraction zone 1, via line 9, through an intermediate locus. In an operating commercial system, a plurality of feed loci is provided to afford flexibility in adjusting for changes in feed rate and aromatic/non-aromatic feed ratios. Solvent, in this case an aqueous solution of sulfolane, is introduced through an upper locus, in the amount of about 3,245.60 lb-moles/hr. (1475.27 kg-moles/hr.), via line 10. The solvent/hydrocarbon volumetric ratio approximates 3.8:1.0. Extractor 1 is maintained at a top temperature of about 210° F. (99° C.), a top pressure of about 75 psig. (6.10 atm.), a bottom temperature of about 183° F. (85° C.) and a bottom pressure of about 115 psig. (8.23 atm.). A bottoms reflux stream, from line 19, the source of which is hereinafter set forth, is introduced at a temperature of about 115° F. (46° C.), in the amount of about 693.96 lb-moles/hr. (315.44 kg-moles/hr.).

A non-aromatic raffinate stream, in the amount of about 83.34 lb-moles/hr. (37.88 kg-moles/hr.), is withdrawn as an overhead stream from extractor 1 and introduced, via line 1, into water-wash column 2, after cooling, at a temperature of about 100° F. (37.8° C.) and a pressure of about 60 psig. (5.08 atm.). A solvent rich aromatic concentrate, in the amount of about4,668.30 lb-moles/hr. (2,121.95 kg-moles/hr.) is withdrawal from extraction zone 1 by way of line 14. In many solvents extraction processes, a portion of the raffinate, withdrawn via line 11, is recycled, without intermediate heating or cooling, to combine with the charge stream in line 9. Since this modification is not necessary to the present invention, it has not been illustrated in the drawing. The raffinate introduced by way of line 11 is countercurrently contacted with a water stream introduced via line 24, in the amount of about 330.39 lb-moles/hr. (150.18 kg-moles/hr.). Net non-aromatic raffinate, substantially free from solvent, in the amount of 82.20 lb-moles/hr. (37.36 kg-moles/hr.), and containing a minor amount of aromatic hydrocarbons, is recovered via line 12 and transported thereby to suitable storage facilities. A water stream, in the amount of about 331.53 lb-moles/hr. (150.70 kg-moles/hr.), containing about 1.14 lb-moles (0.52 kg-moles) of sulfolane, is recovered through line 13.

The 4,668.30 lb-moles/hr. (2,121.95 kg-moles/hr.) of solvent-rich material (about 69.5% by volume sulfolane and water) in line 14, is introduced thereto into stripping column 3. In this illustration, stripper 3 is of the reboiler type as contrasted to one wherein a vaporous stripping medium is introduced directly into the reboiler section of the column. It functions at a top temperature of about 245° F. (118° C.) and a top pressure of about 13.0 psig. (1.88 atm.), and a bottom temperature of 335° F. (168° C.) and a bottom pressure of 18.0 psig. (2.22 atm.). Also introduced into stripping column 3, preferably in admixture with the feed stream in line 14, is a solvent-rich stream in line 25 which has been withdrawn as a side-cut from solvent recovery column 5. The stream in line 25 comprises about 58.91 lb-moles/hr. (26.78 kg-moles/hr.) of water, 1464.0 lb-moles/hr. (665.45 kg-moles/hr.) of sulfolane and about 7.61 lb-moles/hr. (3.46 kg-moles/hr.) of hydrocarbons. Stripper overhead vapor, in an amount of about 760.75 lb-moles/hr. (345.80 kg-moles/hr.), of which about 9.5% by volume is sulfolane and water, is withdrawn through line 15, condensed, and introduced by way of line 16 into stripper overhead receiver 4. Stripper bottoms, substantially free from non-aromatic hydrocarbons, are removed from stripper 3 through line 20 and introduced thereby into solvent recovery column, in the amount of about 5,438.07 lb-moles/hr. (2,471.85 kg-moles/hr.).

Solvent recovery column 5 is maintained at conditions of temperature and pressure sufficient to provide a substantially solvent-free aromatic overhead product in line 21. In this illustration, recovery column 5 has a top temperature of about 145° F. (63° C.), a top pressure of about 283 mm. of Hg., absolute, a bottom temperature of about 337° F. (169° C.) and a bottoms pressure of about 450 mm. of Hg., absolute. The aromatic concentrate in line 21 is recovered in an amount of about 1,060.27 lb-moles/hr. (481.94 kg-moles/hr.). The vaporous overhead material is condensed and introduced into recovery column receiver 6. The aromatic concentrate, in the amount of 729.88 lb-moles/hr. (331.76 kg-moles/hr.) is recovered by way of line 22 and transported thereby to suitable fractionation facilities for the recovery of the individual aromatic components. Water is withdrawn through dip-leg 23, in the amount of about 330.39 lb-moles/hr. (150.18 kg-moles/hr.), and introduced, via line 24 into raffinate water-wash column 2.

Referring now to stripper overhead receiver 4, the feed thereto constitutes 53.29 lb-moles/hr. (24.22 kg-moles/hr.) of water, withdrawn as an overhead vapor in line 16 from water stripper 7, and 760.75 lb-moles/hr. (345.80 kg-moles/hr.) of stripping column 3 overhead vapors in line 15. Receiver 4 effects a phase separation whereby the hydrocarbon portion is removed via line 19 to by introduced into extractor 1 as a bottoms reflux stream. A concentrated water stream, containing about 1.2% by volume of sulfolane, is withdrawn from dip-leg 17 through line 18, in the amount of 120.08 lb-moles/hr. (54.58 kg-moles/hr.). The wash water from column 2, in the amount of 331.53 lb-moles/hr. (150.70 kg-moles/hr.), is admixed via line 13, and the mixture continues through line 18 into an upper portion of water-stripping column 7.

Water stripper 7 functions at a top temperature of about 230° F. (110° C.), a top pressure of about 6.0 psig. (1.41 atm.), a bottom temperature of about 250° F. and a bottom pressure of about 7.0 psig. (1.48 atm.). Overhead vapors, in an amount of 53.29 lb-moles-hr. (24.22 kg-moles/hr.) and containing some non-aromatic hydrocarbons, are withdrawn through line 16, condensed and introduced into stripper receiver 4, in admixture with stripping column 3 overhead vapors. Heat-input to water stripper 7 is supplied by way of indirect heat-exchange with a lean solvent stream introduced via conduit 28 into reboiler section 29, and exiting therefrom through conduit 30. Stripping vapors, in an amount of 392.80 lb-moles/hr. (178.55 kg-moles/hr.) are withdrawn through line 26 and introduced thereby directly into the lower portion of recovery column 5. The principal purpose of this technique is to maintain the lean solvent concentrate in line 10, in the amount of 3,245.60 lb-moles/hr. (1,475.27 kg-moles/hr.) virtually completely free from aromatic hydrocarbons which otherwise would be introduced into the extraction zone with the solvent. As little as 0.5% aromatics in this stream will have an adverse effect upon the efficiency of separation above the feed locus in extractor 1. Also introduced into an intermediate locus of recovery column 5 is a liquid phase from reboiler section 29, via line 27, containing water and solvent in the total amount of 5.52 lb-moles/hr. (2.51 kg-moles/hr.).

About 1,530.52 lb-moles/hr. (695.70 kg-moles/hr.) of solvent, containing about 7.61 lb-moles (3.46 kg-moles/hr.) of aromatics is withdrawn as a side-cut through line 25, and introduced thereby into admixture with the extract phase in line 14; the mixture continues through line 14 into stripping column 3. Either periodically, or on a continuous basis, a portion of the solvent-rich stream in line 10 is diverted through line 31 and introduced into solvent regenerator 8 which functions at a top temperature of about 350° F. (177° C.) and a top pressure of about 520 mm. Hg., absolute. Regenerated solvent is recovered overhead through line 32, as generally practiced in present-day systems, this stream is admixed with the lean solvent in line 10 for introduction therewith into extraction zone 1. Deteriorated solvent plus impurities are removed from the process via line 33.

As previously stated, and as indicated in the foregoing description of the accompanying drawing, my invention involves the double technique of (1) withdrawing a solvent-rich side-cut stream, from an intermediate locus of the recovery column, and introducing it into a locus in the upper portion of the stripping column and, (2) introducing a stripping medium directly into a locus in the lower portion of the recovery column. The principal advantage of the technique resides in decreased utility duty (energy) associated with the recovery column, while simultaneously providing a solvent stream virtually completely free from aromatic hydrocarbons, for recycle to the extraction zone. Additionally, considering the "energy" associated with the bottom of solvent recovery zone 5, the heat-input is supplied by diverting all, or a portion of the lean solvent in line 10 through line 28 into reboiler 29. In the absence of the side-cut solvent withdrawal in line 25, more stripping steam in line 26 is required. Without the recovery column side-cut, the 1,530.52 lb-moles/hr. (695.69 kg-moles/hr.), less the 7.61 lb-moles (3.46 kg-moles) of hydrocarbons would be removed from the bottom via line 10, and then diverted therefrom into the stripping column. The total amount of solvent is constant, having been determined by the requirements of the extraction zone and stripping column. Compared to the present illustration, where 392.80 lb-moles/hr. (178.55 kg-moles/hr.) of steam are required, 476.90 lb-moles/hr. (216.77 kg-moles/hr.) are necessary. At identical temperatures of 250° F. (121° C.), the latter heat-input is $8.12 \times 10^6$ BUT/hr., while the former is $6.69 \times 10^6$ BTU/hr., or an energy savings of $1.42 \times 10^6$ BTU/hr. Those skilled in the art will recognize how this can be translated advantageously within the process. For example, since the lean solvent return in line 30 is at a higher temperature, it may be used to pre-heat the extract phase in line 14 which will reflect a lower required heat-input in the stripper reboiler. Introducing the side-cut from the recovery column into the stripper column in admixture with the feed, affords an enhancement of the non-aromatic/aromatic separation in the upper regions of the stripper.

I claim as my invention:

1. A method for separating polar hydrocarbons from a mixture thereof with non-polar hydrocarbons and an aqueous solvent characteristically selective for absorbing polar hydrocarbons, which method comprises the steps of:

a. introducing said mixture into a first fractionation column, removing a water-containing, non-polar hydrocarbon-rich stream from an upper portion of said first column and removing a solvent-rich, polar hydrocarbon-containing stream from a lower portion of said first column;

b. introducing at least a portion of said solvent-rich, polar hydrocarbon-containing stream into a second fractionating column, removing a polar hydrocarbon-rich stream, substantially free from solvent and non-polar hydrocarbons, from an upper portion of said second column, removing a first solvent-rich stream, substantially free from hydrocarbons, from a lower portion of said second column and removing a hydrocarbon-containing, second solvent-rich stream from an intermediate portion of said second column;

c. separating water from said non-polar hydrocarbon-rich stream removed from the upper portion of said first column in step (a) and vaporizing the same to form steam;

d. introducing stream from step (c) as a vaporous stripping medium into said second fractionation column through a locus below that from which said second solvent-rich stream is removed; and, e. introducing at least a portion of said second solvent-rich stream into said first fractionation column.

2. The method of claim 1 further characterized in that said portion of the second solvent-rich stream is introduced into said first column with said mixture.

3. The method of claim 1 further characterized in that said polar hydrocarbons are aromatic and said non-polar hydrocarbons are naphthenic.

4. The method of claim 1 further characterized in that said aqueous solvent is a sulfolane-type organic compound.

5. The method of claim 1 further characterized in that said aqueous solvent is a polyalkylene glycol.

6. A process for the recovery of aromatic hydrocarbons from a mixture thereof with non-aromatic hydrocarbons, which process comprises the steps of:

a. introducing said mixture into an extraction zone, and therein contacting said mixture with a solvent characteristically selective for absorbing aromatic hydrocarbons, at conditions selected to maintain said mixture and solvent in liquid phase;

b. removing a non-aromatic raffinate stream from said zone, through an upper locus thereof;

c. water washing said raffinate stream and then vaporizing the wash water to form steam;

d. removing an aromatic, solvent-rich extract stream from said zone, through a lower locus thereof, and introducing said extract stream into a stripper column;

e. removing a non-aromatic concentrate from said stripper column, through an upper locus thereof, and removing a solvent-rich aromatic concentrate from said stripper column, through a lower locus thereof;

f. introducing said aromatic concentrate into a recovery column, through a first locus thereof, introducing at least a portion of said steam from step (c) as a vaporous stripping medium into a lower, second locus thereof, recovering a substantially solvent-free aromatic concentrate through an upper, third locus thereof, removing a substantially hydrocarbonfree, first solvent-rich stream from a lower, fourth locus thereof and removing a second solvent-rich stream, containing hydrocarbons, through a fifth locus intermediate said first and second loci; and g. introducing at least a portion of said second solvent-rich stream into said stripper column.

7. The process of claim 6 further characterized in that the portion of said second solvent-rich stream is introduced into said recovery column in admixture with said solvent-rich extract stream.

8. The process of claim 6 further characterized in that the volumetric ratio of said first solvent-rich stream to said second solvent-rich stream is in the range of about 1.5:1.0 to about 4.0:1.0.

9. The process of claim 6 further characterized in that said solvent is a sulfolane-type organic compound.

10. The process of claim 6 further characterized in that said solvent is a polyethylene glycol.

* * * * *